US010519714B2

(12) United States Patent
Gaugler

(10) Patent No.: US 10,519,714 B2
(45) Date of Patent: Dec. 31, 2019

(54) METHODS AND DEVICES FOR ELECTROSTATIC DISCHARGE OF A WORKPIECE

(71) Applicant: The Boeing Company, Chicago, IL (US)

(72) Inventor: Steve W. Gaugler, Lancaster, CA (US)

(73) Assignee: The Boeing Company, Chicago, IL (US)

( * ) Notice: Subject to any disclaimer, the term of this patent is extended or adjusted under 35 U.S.C. 154(b) by 46 days.

(21) Appl. No.: 15/631,340

(22) Filed: Jun. 23, 2017

(65) Prior Publication Data

US 2018/0371836 A1 Dec. 27, 2018

(51) Int. Cl.

| | |
|---|---|
| ***E06C 1/383*** | (2006.01) |
| ***E06C 1/18*** | (2006.01) |
| ***E06C 1/397*** | (2006.01) |
| ***E06C 7/42*** | (2006.01) |

(52) U.S. Cl.

CPC ..... *E06C 1/383* (2013.01); *E06C 1/18* (2013.01); *E06C 1/397* (2013.01); *E06C 7/42* (2013.01)

(58) Field of Classification Search

CPC ..... E06C 1/18; E06C 1/22; E06C 1/16; E06C 7/42; E06C 7/423; E06C 7/44; E06C 7/188; H05F 1/00; H05F 1/02; H05F 3/00; H05F 3/02; H05F 3/025; H05F 3/06; H05F 7/00; H02G 13/00

USPC ..... 16/82–85

See application file for complete search history.

(56) References Cited

U.S. PATENT DOCUMENTS 1,613,806 A * 1/1927 Rickenbacher ..... E05C 17/446 16/85
1,628,826 A * 5/1927 Covalence ..... E05F 5/06 16/85
1,890,423 A * 12/1932 Teagarden ..... F41A 23/00 248/354.6
2,261,479 A * 11/1941 Moen ..... E06C 1/22 182/125
2,881,467 A * 4/1959 Struhar ..... E05F 3/02 16/66
3,038,972 A * 6/1962 Lagier ..... H01R 13/7036 174/7
3,641,619 A * 2/1972 Roylance ..... E06C 1/397 182/127

(Continued)

*Primary Examiner* — Katherine W Mitchell
*Assistant Examiner* — Shiref M Mekhaeil
(74) *Attorney, Agent, or Firm* — McDonnell Boehnen Hulbert & Berghoff LLP

(57) ABSTRACT

Example implementations relate to methods and devices for electric discharge of a workpiece. An example device includes a housing structure configured with an inner portion that extends partially into an outer portion and an elongate rod positioned inside the housing structure. The device also includes a cover component coupled to a first end of the rod proximate a slot of the outer portion of the housing structure, and a lock coupled around the rod proximate a slot of the inner portion of the housing structure. The device also includes a compressible spring positioned within the housing structure, a ground component coupled to a second end of the rod, and an attachment component that is configurable for coupling the device to a workpiece such that the ground component presses against a ground when the workpiece is positioned on the ground and is in use.

14 Claims, 7 Drawing Sheets

(56) References Cited

U.S. PATENT DOCUMENTS 4,202,108 A * 5/1980 Adams, Jr. ..... B44D 3/38 33/379
4,302,864 A * 12/1981 Morita ..... E05C 17/50 16/85
4,415,062 A * 11/1983 Shaw ..... E06C 7/46 182/109
4,686,740 A * 8/1987 Ishii ..... E05C 17/446 16/85
4,766,976 A * 8/1988 Wallick, Jr. ..... E06C 7/44 182/111
5,120,923 A * 6/1992 Kato ..... H01H 13/705 200/341
5,220,706 A * 6/1993 Bivens ..... E05F 3/02 16/66
5,401,926 A * 3/1995 Aoyama ..... H05F 3/02 200/305
5,590,739 A * 1/1997 High ..... E06C 1/12 182/169
6,145,901 A * 11/2000 Rich ..... B25J 15/026 294/189
6,189,653 B1 * 2/2001 Laug ..... E06C 1/39 182/152
6,321,412 B1 * 11/2001 Duco ..... E05F 5/10 16/85
6,610,937 B2 * 8/2003 Yamaguchi ..... H01H 25/008 200/11 R
6,688,426 B1 * 2/2004 Mikros ..... E06C 1/397 182/107
7,017,229 B2 * 3/2006 Walcome ..... E05C 17/50 16/82
D560,001 S * 1/2008 Moss ..... D25/68
7,937,807 B2 * 5/2011 Bereznai ..... E05F 5/10 16/82
9,516,948 B2 * 12/2016 Migli ..... E05C 19/022
9,741,507 B2 * 8/2017 Nishino ..... H01H 13/7073
2001/0013444 A1 * 8/2001 Gillis ..... E06C 1/39 182/15
2006/0152880 A1 * 7/2006 Lander ..... A61N 1/14 361/220
2006/0278474 A1 * 12/2006 Cumbie ..... E06C 1/12 182/207
2007/0044274 A1 * 3/2007 Chen ..... E05C 17/446 16/82
2007/0234511 A1 * 10/2007 Rutledge ..... B64C 1/14 16/82
2008/0029341 A1 * 2/2008 Cooper ..... E06C 7/423 182/107
2008/0093166 A1 * 4/2008 Frolik ..... E04G 1/24 182/17
2008/0203738 A1 * 8/2008 Peterlunger ..... E05C 19/165 292/251.5
2008/0217103 A1 * 9/2008 Pucek ..... E06C 1/39 182/15
2010/0071994 A1 * 3/2010 Tseng ..... E06C 1/125 182/27
2011/0017548 A1 * 1/2011 Green ..... E06C 1/10 182/108
2011/0119865 A1 * 5/2011 Vigeh ..... B64C 1/14 16/82
2012/0048647 A1 * 3/2012 Green ..... E06C 1/16 182/111
2013/0043716 A1 * 2/2013 Chen ..... B60B 7/02 301/63.101
2015/0026923 A1 * 1/2015 Nakasone ..... E05F 1/105 16/85
2015/0361707 A1 * 12/2015 Swanberg ..... E05F 5/06 16/83
2016/0356826 A1 * 12/2016 Ball ..... G01R 19/0092
2018/0159331 A1 * 6/2018 Bilic ..... G01R 19/0015
2018/0230746 A1 * 8/2018 Maxfield ..... E06C 7/42
2018/0235313 A1 * 8/2018 Tersigni ..... A43B 7/36
2018/0313885 A1 * 11/2018 Bilic ..... G01R 31/025

* cited by examiner

METHODS AND DEVICES FOR ELECTROSTATIC DISCHARGE OF A WORKPIECE

FIELD

The present disclosure relates generally to the electrostatic discharge of a workpiece, and more particularly to, example methods and devices for creating electrical conductivity between a workpiece (e.g., ladder) and a conductive ground that the workpiece is positioned on such that any electrostatic charge built up within the workpiece may discharge into the ground.

BACKGROUND

Ladders and other types of workpieces are typically made out of light-weight materials (e.g., aluminum, metal) capable of maintaining structure while supporting the weight of a user or the user's items. The strength and weight of the materials can enable a workpiece to be moved easily while also provide structure and support during use. Many of these materials, however, are also electrical conductors that allow the flow of electrostatic charge within portions of the workpiece.

When exposed to some source of electricity, an electrostatic charge can build up within the conducting materials of a workpiece. For instance, when a user pushes a ladder in an area with electrostatic control requirements, the ladder may build up electrostatic charge within the steps and other metal or aluminum portions of the ladder. Although a fully conducting workpiece (e.g., a full metal ladder) would allow for any built up electrostatic charge to flow from the workpiece into the ground, most workpieces often include non-slip pads (e.g., rubber feet) that are included to prevent unwanted movement during use. Since the non-slip pads are usually rubber or other non-conducting materials that create friction between the workpiece and the ground, the pads can block the electrostatic charge from discharging into the ground resulting in potential risks to users and electrostatic-sensitive items.

Therefore, there is a need to create electrical conductivity from a workpiece to the ground to allow electrostatic charge to discharge from the workpiece. One such technique often used can involve discharging electrostatic charge from a workpiece through a grounding wire that connects conducting materials of the workpiece to the ground. Using a grounding wire, however, limits the mobility of the workpiece and can sometimes fail to adequately ground the workpiece. Thus, what are needed are techniques that safely discharge electrostatic charge from a workpiece without limiting the mobility and use of the workpiece.

SUMMARY

In one example, a device is described comprising a housing structure configured with an inner portion that extends partially into an outer portion. Particularly, the inner portion and outer portion move relative to each other. The device also includes an elongate rod positioned inside the housing structure. A first end of the elongate rod extends through a top of the housing structure and a second end of the elongate rod extends through a bottom of the housing structure. The device also includes a compressible spring positioned within the housing structure. The spring is partially compressed between the top of the housing structure and the bottom of the housing structure such that a first end of the spring presses against an inner surface of the outer portion of the housing structure and a second end of the spring presses against an inner surface of the inner portion of the housing structure. The device also includes a ground component coupled to the second end of the elongate rod, and an attachment component coupled to the outer portion of the housing structure. The attachment component is configurable for coupling the device to a workpiece such that the ground component presses against a ground surface when the workpiece is positioned on the ground surface and is in use.

In another example, a system is described comprising a workpiece and a device configurable to couple to the workpiece. The device comprises a housing structure configured with an inner portion that extends partially into an outer portion. The inner portion and outer portion move relative to each other. The device also includes an elongate rod positioned inside the housing structure. A first end of the elongate rod extends through a top of the housing structure and a second end of the elongate rod extends through a bottom of the housing structure. The device also includes a cover component coupled to the first end of the elongate rod, and a lock coupled to the elongate rod. The lock is positioned outside the housing structure. The device also includes a compressible spring positioned within the housing structure. The spring is partially compressed between the top of the housing structure and the bottom of the housing structure such that a first end of the spring presses against an inner surface of the outer portion of the housing structure and a second end of the spring presses against an inner surface of the inner portion of the housing structure. The device also includes a ground component coupled to the second end of the elongate rod, and an attachment component coupled to the outer portion of the housing structure. The attachment component is for coupling the device to the workpiece such that the ground component presses against a ground surface when the workpiece is positioned on the ground surface and is in use.

In another example, a method is described. The method includes coupling, via an attachment component of a device, a housing structure of the device to a workpiece such that a ground component of the device presses against a ground surface when the workpiece is positioned on the ground surface and is in use. The housing structure includes an inner portion that extends partially into an outer portion, and the inner portion and the outer portion move relative to each other. The method also includes responsive to an application of downward force on the workpiece, compressing a compressible spring positioned within the housing structure of the device. The spring is partially compressed between the top of the housing structure and the bottom of the housing structure such that a first end of the spring presses against an inner surface of the outer portion of the housing structure and a second end of the spring presses against an inner surface of the inner portion of the housing structure. The method also includes responsive to compressing the compressible spring, causing the ground component of the device to extend toward the ground surface.

The features, functions, and advantages that have been discussed can be achieved independently in various examples or may be combined in yet other examples further details of which can be seen with reference to the following description and drawings.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying drawings, wherein:

DETAILED DESCRIPTION

Disclosed examples will now be described more fully hereinafter with reference to the accompanying drawings, in which some, but not all of the disclosed examples are shown. Indeed, several different examples may be described and should not be construed as limited to the examples set forth herein. Rather, these examples are described so that this disclosure will be thorough and complete and will fully convey the scope of the disclosure to those skilled in the art.

Example implementations describe methods and devices for electrostatic discharge of a workpiece. Particularly, examples involve establishing electrical conductivity between a workpiece and the ground surface that the workpiece is positioned upon when the workpiece is in use. The connection can enable electrostatic charge that built up within the workpiece to discharge into the ground.

Example implementations also aim to permit a user to easily move a workpiece when the workpiece is not in use. Unlike a ground wire that limits the mobility of the workpiece to the length of the ground wire, an example implementation involves coupling one or more devices to a workpiece in a manner that enables any electric charge built up within the workpiece to flow through at least one of the devices into the ground. Each device can be used to establish electrical conductivity between the workpiece and the ground, such as when the workpiece is in use. As a result, a user can safely use the workpiece during electrical work without the risk of potential electrical shocks and also have the ability to move the workpiece to different locations between uses.

Figure 1:
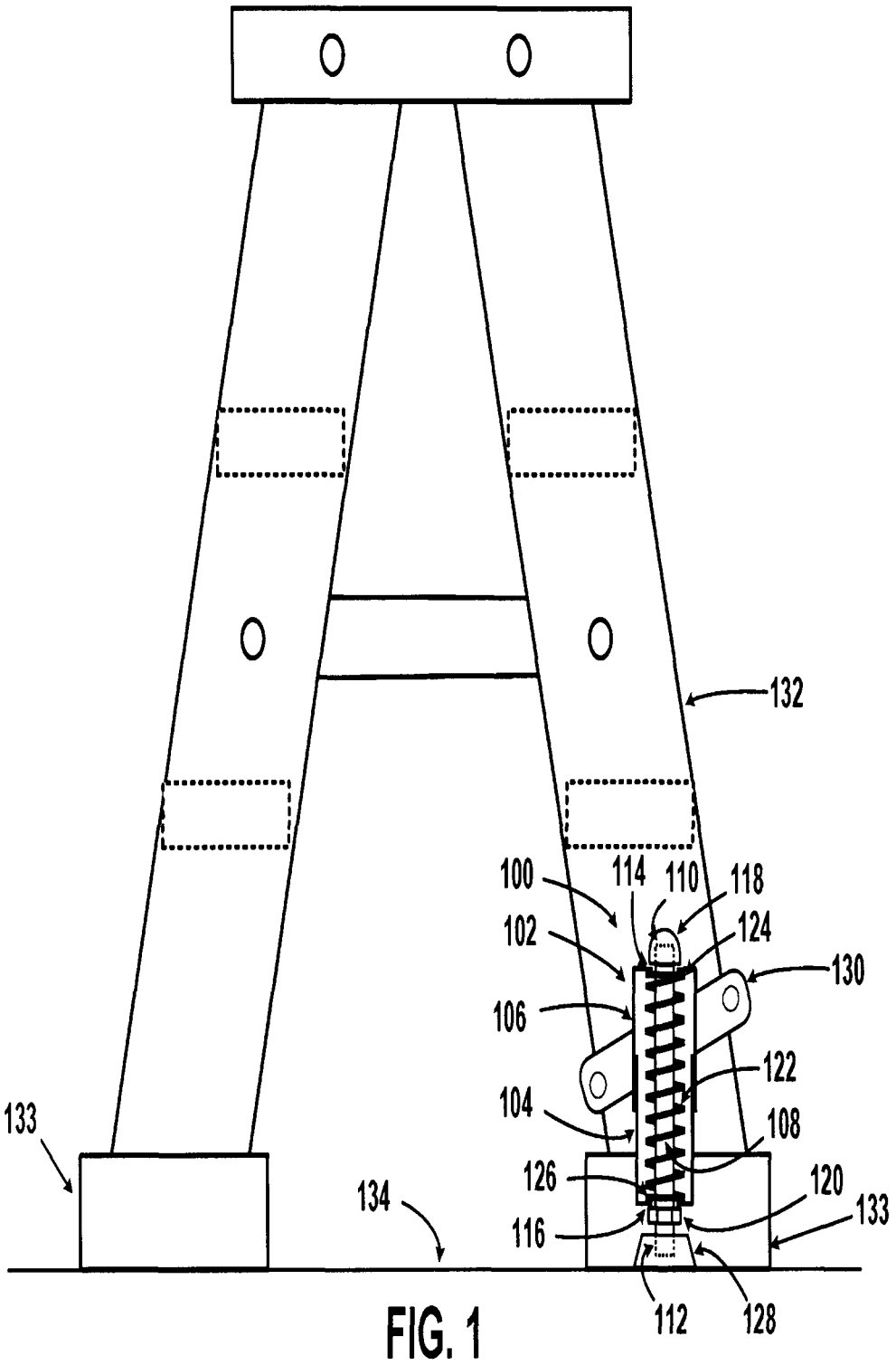
FIG. 1 is a conceptual illustration of a device coupled to a workpiece, according to an example implementation.

Referring now to the Figures, FIG. 1 is a conceptual illustration of a device 100 coupled to a workpiece 132, according to an example implementation. The device 100 includes a housing structure 102 configured with an inner portion 104 and an outer portion 106. Inside the housing structure 102, the device 100 includes an elongate rod 108 with a compressible spring 122 shown positioned around the elongate rod 108. The device 100 also includes a cover component 118, a lock 120, a ground component 128, and an attachment component 130 configurable for coupling the device 100 to the workpiece 132. Additional configurations are described below.

Components of the device 100 may include one or more conductive materials capable of conducting electricity to enable electrostatic charges to discharge from conductive materials of a workpiece (e.g., workpiece 132) into a conductive ground surface (e.g., ground surface 134). For instance, in some example implementations, all or a subset of components of the device 100 may be made out of aluminum, metal, or other materials with the ability to conduct electrostatic charges.

The device 100 includes the housing structure 102 to protect components (e.g., the elongate rod 108, the compressible spring 122). In the example implementation, the housing structure 102 is configured with an inner portion 104 that extends partially into an outer portion 106. As shown, the inner portion 104 and the outer portion 106 move relative to each other. For instance, the inner portion 104 and the outer portion 106 can be physically separate components of the housing structure 102 with the diameter of the outer portion 106 greater than the diameter of the inner portion 104. For example, the outer portion 106 can have a diameter that is greater than the diameter of the inner portion 104 by at least a thickness of the walls of the housing structure 102.

Additionally, the housing structure 102 can have various configurations within examples, such as a circular or octagonal configuration. In another example implementation shown in FIG. 5 and FIG. 6, the housing structure 102 can also have a rectangular structure. In a further example, the device 100 may not include a housing structure. Instead, the attachment component 130 may couple to a different portion of the device 100, such as a portion of the elongate rod 108.

Inside the housing structure 102, the elongate rod 108 is positioned such that a first end 110 of the elongate rod 108 extends through a top of the housing structure 102 via a slot 114 in the outer portion 106 of the housing structure 102. In addition, the second end 112 of the elongate rod 108 extends through a bottom of the housing structure 102 via a slot 116 in the inner portion 104 of the housing structure 102. As shown in FIG. 1, the slot 114 in the outer portion 106 of the housing structure 102 is aligned with the slot 116 in the inner portion 104 of the housing structure 102. This alignment allows the elongate rod 108 to have a vertical orientation relative to the workpiece 132. In other examples, the slots 114, 116 can have other positions in the housing structure 102 that may cause the elongate rod 108 to have other orientations. Further, in other examples, parameters of the elongate rod 108 can differ.

The cover component 118 is coupled to the first end 110 of the elongate rod 108. Particularly, the cover component 118 is positioned proximate the slot 114 of the outer portion 106 of the housing structure 102. As such, the cover component 118 may hold the elongate rod 108 in place relative to the outer portion 106 of the housing structure 102. In the example implementation shown in FIG. 1, the cover component 118 is a cap bolt, but can have other configurations within other implementations.

Additionally, in a further example, the device 100 may not include the cover component 118. Rather, the first end 110 of the elongate rod 108 may have a greater diameter than the slot 114 of the outer portion 106 of the housing structure 102. At such a diameter, the first end 110 can press against the top of the housing structure 102 and hold the rest of the elongate rod 108 fixed within the housing structure 102 in a manner similar to the cover component 118.

The lock 120 is coupled to the elongate rod 108 proximate the slot 116 of the inner portion 104 of the housing structure 102. The lock 120 is positioned outside the housing structure 102 such that the lock 120 can prevent the inner portion 104 of the housing structure 102 from slipping down toward the ground component 128. In the example implementation shown in FIG. 1, the lock 120 is a bolt that extends completely around the elongate rod 108. In other examples, the lock 120 can have other configurations.

In a further example, the device 100 might not include the lock 120. Rather, the ground component 128 may couple to the elongate rod 108 proximate the bottom of the housing structure 102 proximate the slot 116 in the inner portion 104 of the housing structure 102.

The compressible spring 122 is positioned within the housing structure 102. In some examples, the compressible spring 122 is positioned around the elongate rod 108. In other examples, the compressible spring 122 may have other positions (e.g., next to the elongate rod 108).

As shown in FIG. 1, the spring 122 is partially compressed between the top of the housing structure 102 and the bottom of the housing structure 102 such that a first end 124 of the spring 122 presses against an inner surface of the outer portion 106 of the housing structure 102 and a second end 126 of the spring 122 presses against an inner surface of the inner portion 104 of the housing structure 102. The amount that the inner portion 104 of the housing structure 102 extends into the outer portion 106 of the housing structure depends on an amount of compression of the compressible spring 122. The position and compression of the compressible spring 122 can help the ground component 128 maintain firm contact with the conductive ground surface 134.

In some examples, the compressible spring 122 is positioned around and unattached to the elongate rod 108 (i.e., floating around the elongate rod 108) within the housing structure 102. The compressible spring 122 is floating around the elongate rod 108 when no portion of the compressible spring 122 is attached to the elongate rod 108. Rather, the elongate rod 108 simply extends through the center of the compressible spring 122.

The ground component 128 of the device 100 is coupled to the second end 112 of the elongate rod 108. When the workpiece 132 is positioned on the ground surface 134 and is in use, the device 100 can allow any electrostatic charges in the workpiece 132 to discharge through the device 100 into the ground surface 134 via the ground component 128. The ground component 128 can be made out of metal or other conductive materials that allow for electrostatic charges to discharge from conductive materials of the workpiece 132 into the conductive ground surface 134.

The attachment component 130 is coupled to the outer portion 106 of the housing structure 102. Particularly, the attachment component 130 is configurable for coupling the device 100 to a conductive portion of the workpiece 132 such that the ground component 128 presses against a ground surface 134 when the workpiece 132 is positioned on the ground surface 134 and is in use. Electrostatic charge from the conductive portion of the workpiece 132 can flow into the device 100 through the attachment component 130 or another component of the device 100 and then further flow through the device 100 into the conductive ground surface 134 via the ground component 128. In some examples, the attachment component 130 can include a clamping element that enables the device 100 to couple to a portion of the workpiece 132. The attachment component 130 can also have other configurations configurable to attach the device 100 to the workpiece 132.

Figure 2:
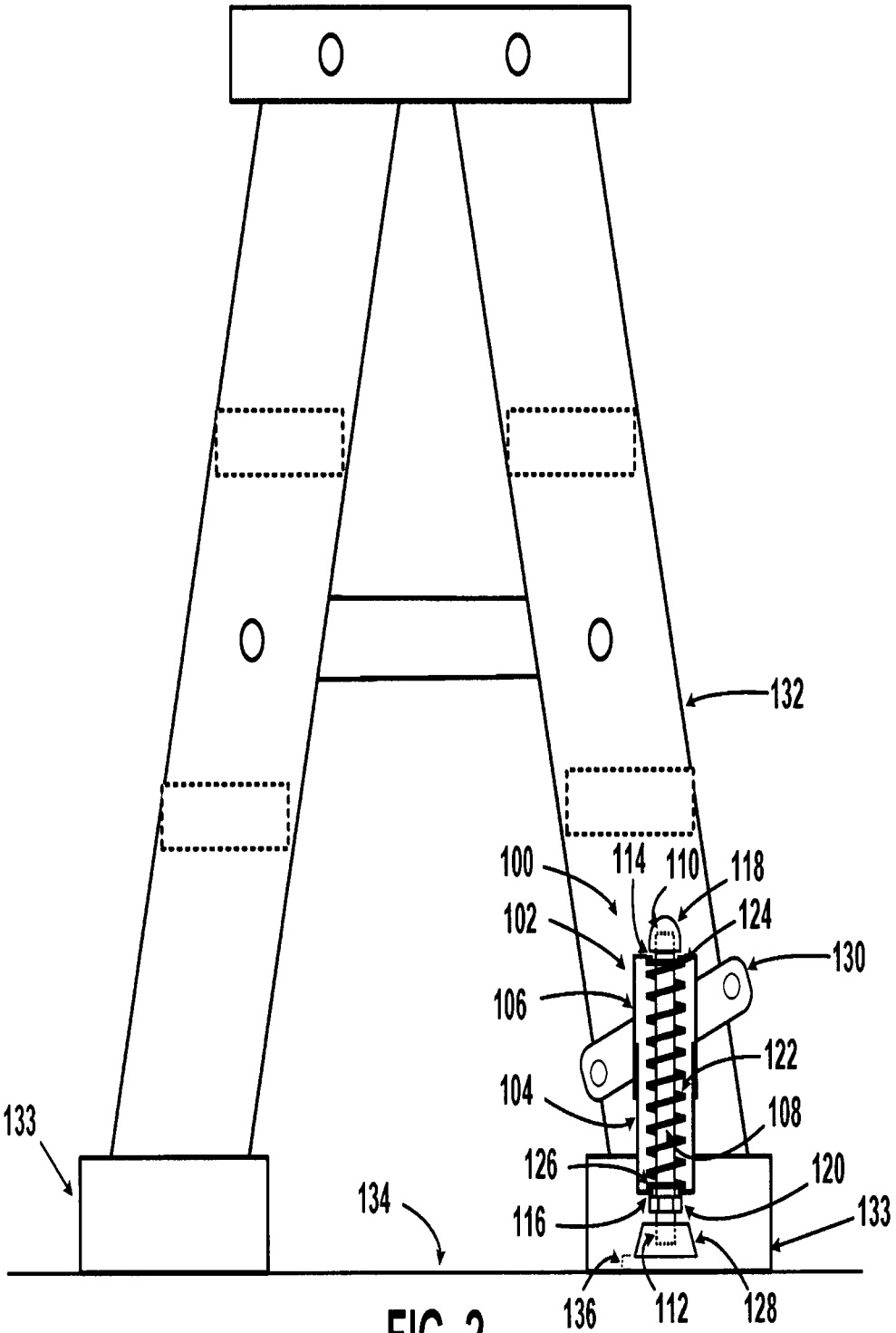
FIG. 2 is another conceptual illustration of the device coupled to the workpiece when the workpiece is not in use, according to an example implementation.

FIG. 2 is another conceptual illustration of the device 100 coupled to the workpiece 132 when the workpiece 132 is not in use, according to an example implementation. In particular, when the device 100 is attached to the workpiece 132, the attachment component 130 can connect the device 100 in a manner that allows the workpiece 132 to be moved when the workpiece 132 is not in use without the device 100 causing friction with the ground surface 134. As shown in the example implementation, without an application of downward force on the workpiece 132, the device 100 can be positioned such that the ground component 128 does not maintain firm contact with the ground surface 134 resulting in the gap 136 between the ground component 128 and the ground surface 134. The size of the gap 136 can vary depending on the position of the device 100 relative to the workpiece 132.

The workpiece 132 is shown in FIGS. 1 and 2 is a ladder, but may be other types of workpieces, such as workbenches or other mechanical structures within other examples. Particularly, the workpiece 132 can include aluminum, metal, or other conductive materials that can capture electrostatic charges. For instance, electrostatic charges may build up within the workpiece 132 as a user moves the workpiece 132 throughout an environment. The workpiece 132 can also including non-slip pads 133 made out of rubber or a similar material that prevents the electrostatic charges from discharging from the workpiece 132 into the conductive ground surface 134. As a result, the device 100 can be used to provide a reliable electrical path for bleeding off electrostatic charge into the ground surface 134 to prevent the electrostatic charge from potentially shocking a user or damaging electrostatic-sensitive items. As shown, the device 100 can discharge electrostatic charges from the workpiece 132 with minimal or no modifications to the workpiece 132.

Figure 3:
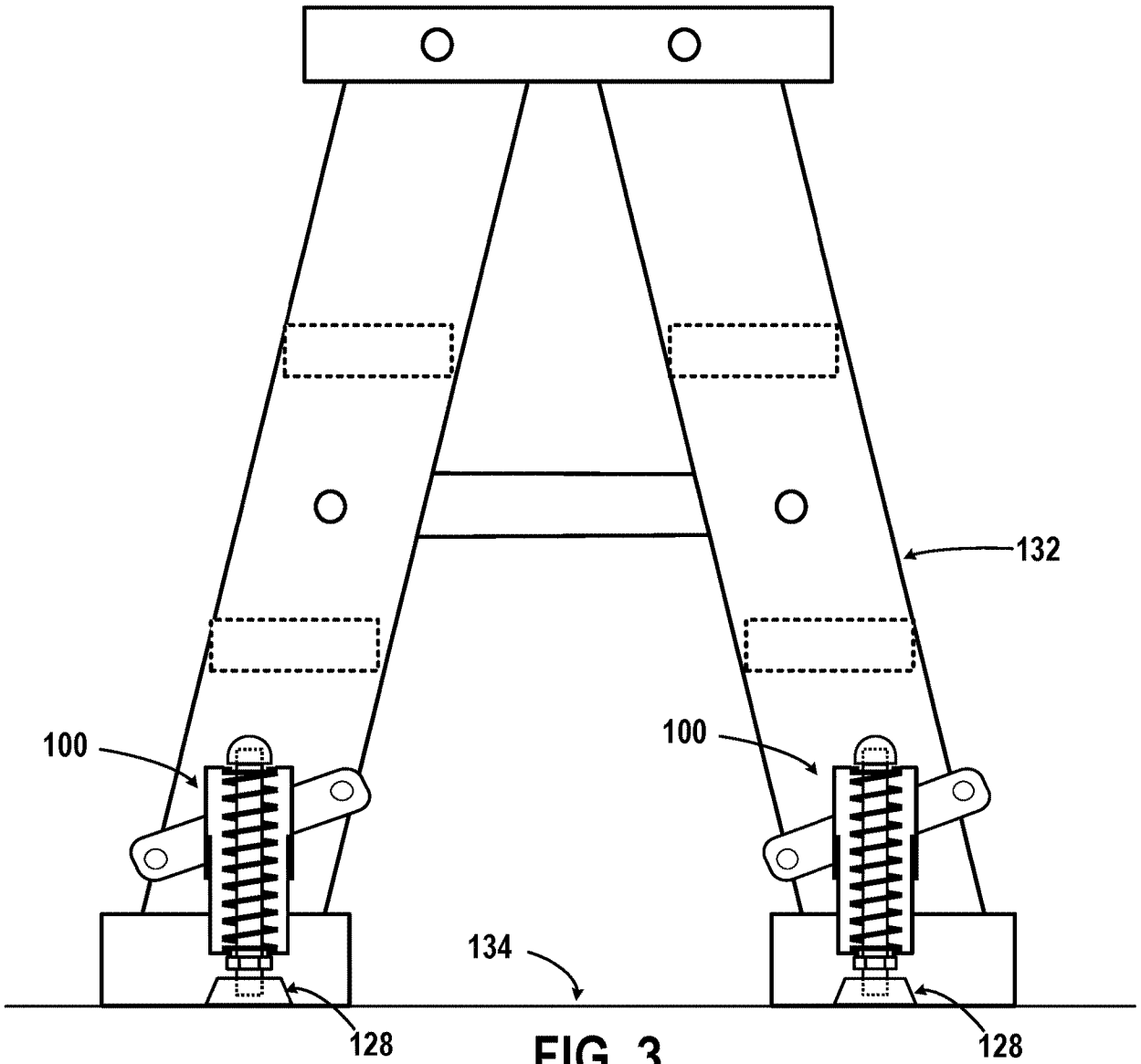
FIG. 3 is a conceptual illustration of multiple devices coupled to the workpiece, according to an example implementation.

FIG. 3 is a conceptual illustration of multiple devices 100 coupled to the workpiece 132, according to an example implementation. In the example implementation, the workpiece 132 is shown with multiple devices 100 coupled to different portions of the workpiece 132. For instance, a ladder can have devices coupled to each leg of the ladder. Discharging the workpiece 132 then can involve using the multiple devices 100 to create multiple paths for electrostatic charges to discharge from the workpiece 132 into the ground surface 134. With a redundant set up, the different electrical conductivity connections between the workpiece 132 and the ground surface 134 can help reduce the risk that electrostatic charge remains within the workpiece 132. In particular, although one portion of the workpiece 132 can shift during use in a manner that displaces the ground component 128 of one of the devices 100 off the ground surface 134, another device 100 positioned on another portion of the workpiece 132 can still allow electrostatic charges to discharge from the workpiece 132 into the ground surface 134.

Figure 4:
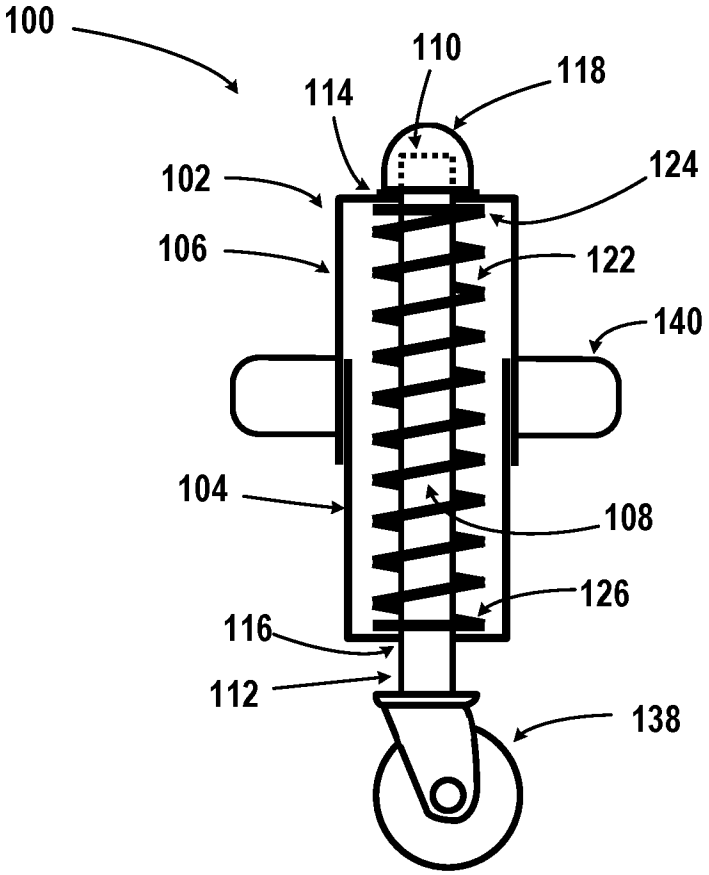
FIG. 4 is a conceptual illustration of another device, according to an example implementation.

FIG. 4 is a conceptual illustration of another device 100, according to an example implementation. The device 100 is configured with a wheel 138 connected to the second end 112 of the elongate rod 108. The wheel 138 is made out of one or more conductive materials that enable electrostatic charges within a workpiece (e.g., workpiece 132) to discharge through the device 100 into the ground (e.g., ground surface 134) in a manner similar to the ground component 128. For instance, conductive materials of the wheel 138 and other components of the device 100 can include iron, chrome, aluminum, brass, steel, bronze, silver, and metal, among other possibilities. The size and configuration of the wheel 138 can differ within examples.

In addition, an attachment component 140 shown in FIG. 4 represents a different configuration capable of attaching the device 100 to a workpiece. In particular, the attachment component 140 can be used to attach the device 100 to a workpiece with a different configuration, such as platform ladder.

Figure 5:
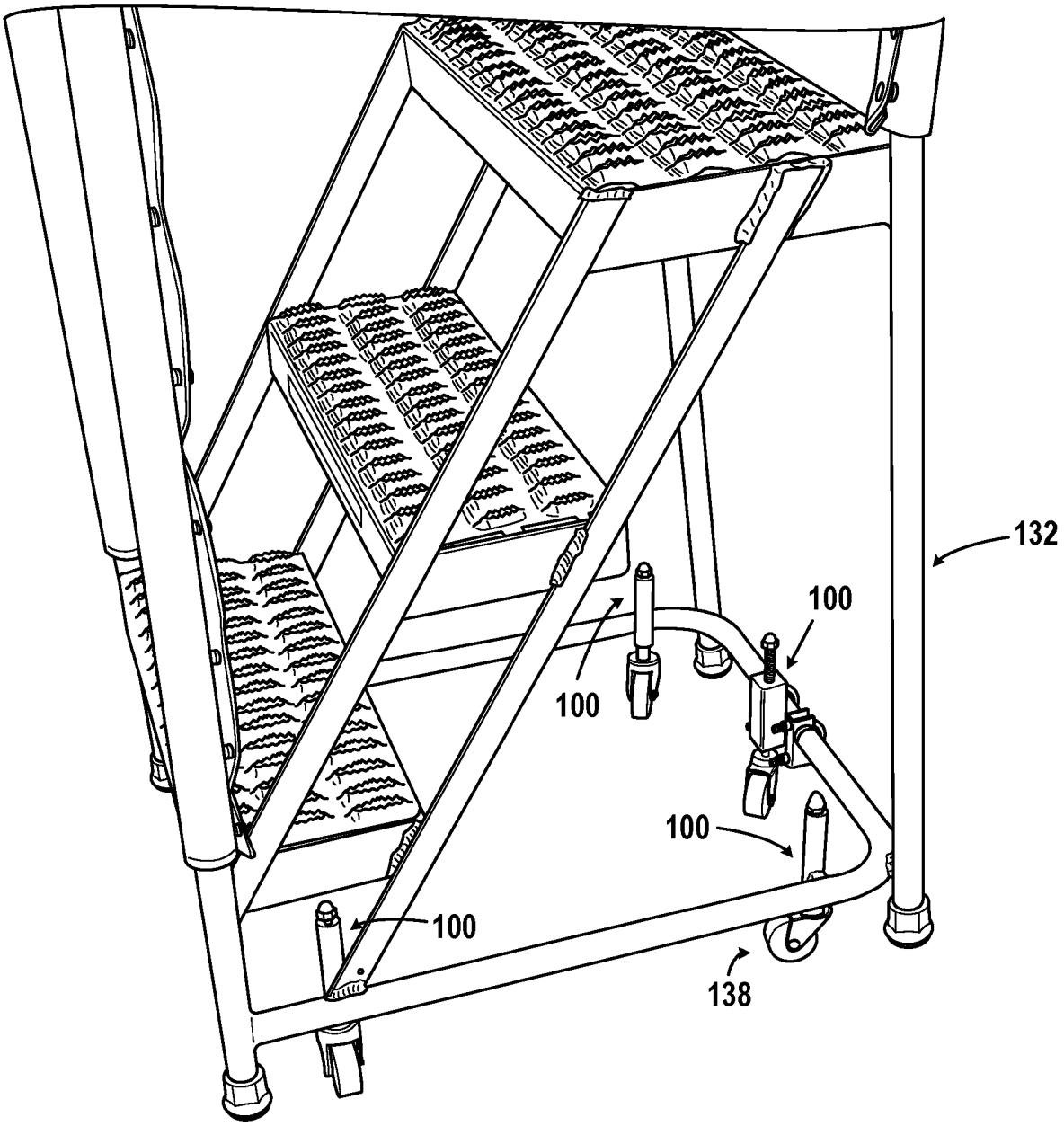
FIG. 5 is a conceptual illustration of multiple devices coupled to a workpiece, according to an example implementation

FIG. 5 is a conceptual illustration of multiple devices 100 coupled to a workpiece 132, according to an example implementation. In particular, multiple devices 100 configured with wheels 138 are coupled to portions of a large workpiece (e.g., a platform ladder) to enable easy movement of the workpiece while also allowing the multiple devices 100 to discharge electrostatic charges that built up within the workpiece. For example, as a user pushes the large workpiece around, the devices 100 may discharge electrostatic charges from the workpiece 132 into a conductive ground via the wheels 138.

In addition, when the workpiece is in use, the devices 100 configured with wheels 138 can still discharge electrostatic charges within the workpiece as a result of a downward force applied to the workpiece even when the workpiece also includes rubber non-slip pads that prevent unwanted movements. In particular, when the workpiece is configured for use, the wheels 138 can maintain contact within the ground enabling electrostatic charge to discharge from the workpiece while bottom portions (e.g., non-slip pads) of the workpiece maintain the position and balance of the workpiece. The compression spring 122 within the device 100 can compress to allow the wheels 138 to shift upward to enable the bottom portions of the workpiece to engage the ground surface while also keeping the wheels 138 in contact with the ground surface as well. In a further example, the wheels 138 can include a locking mechanism to prevent the wheels 138 from rotating during use of the workpiece.

Figure 6:
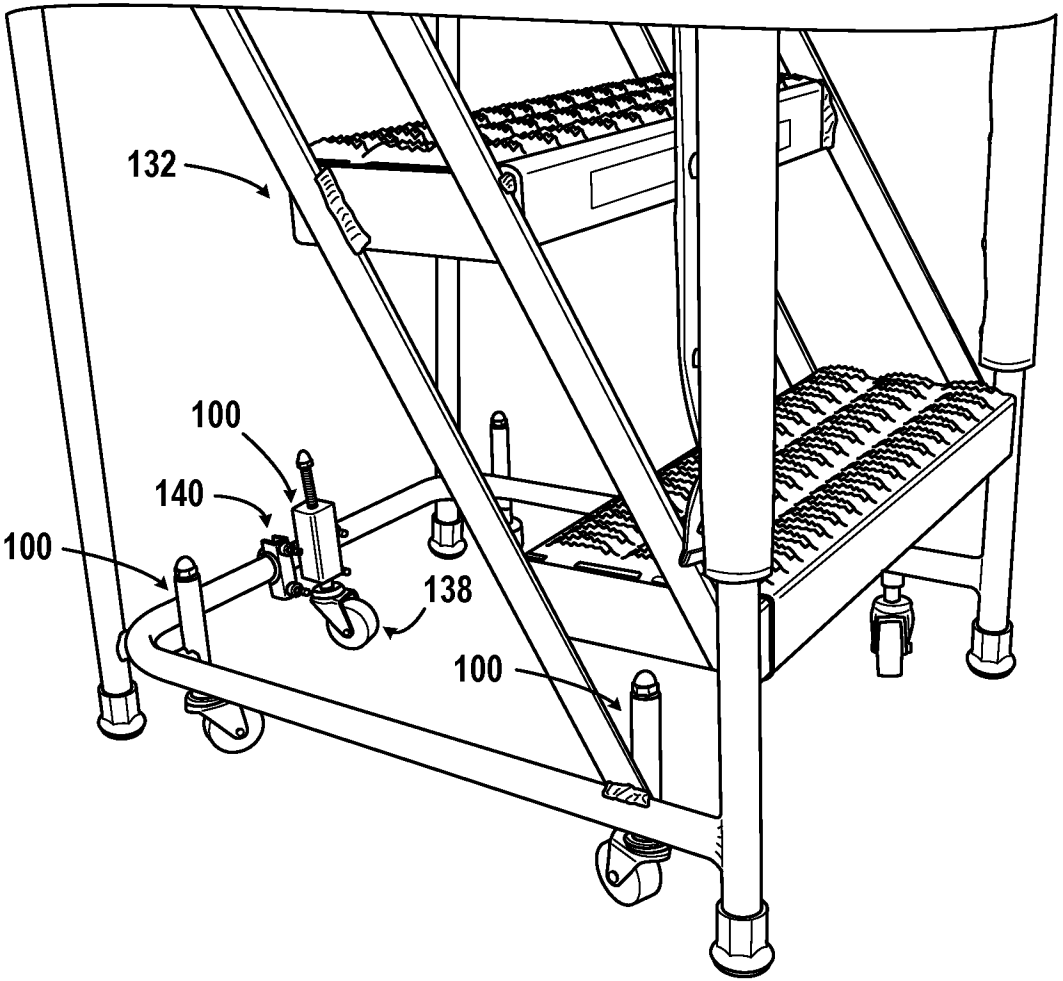
FIG. 6 is an additional conceptual illustration of multiple devices coupled to the workpiece, according to an example implementation.

FIG. 6 is an additional conceptual illustration of multiple devices 100 coupled to the workpiece 132, according to an example implementation. As shown, the devices 100 may couple to different portions of the workpiece 132 using attachment components 140. The configuration can enable the devices 100 to discharge electrostatic charge into the ground (e.g., a conductive floor) through the conductive wheels 138 while the workpiece 132 is pushed to different locations on the ground.

Figure 7:
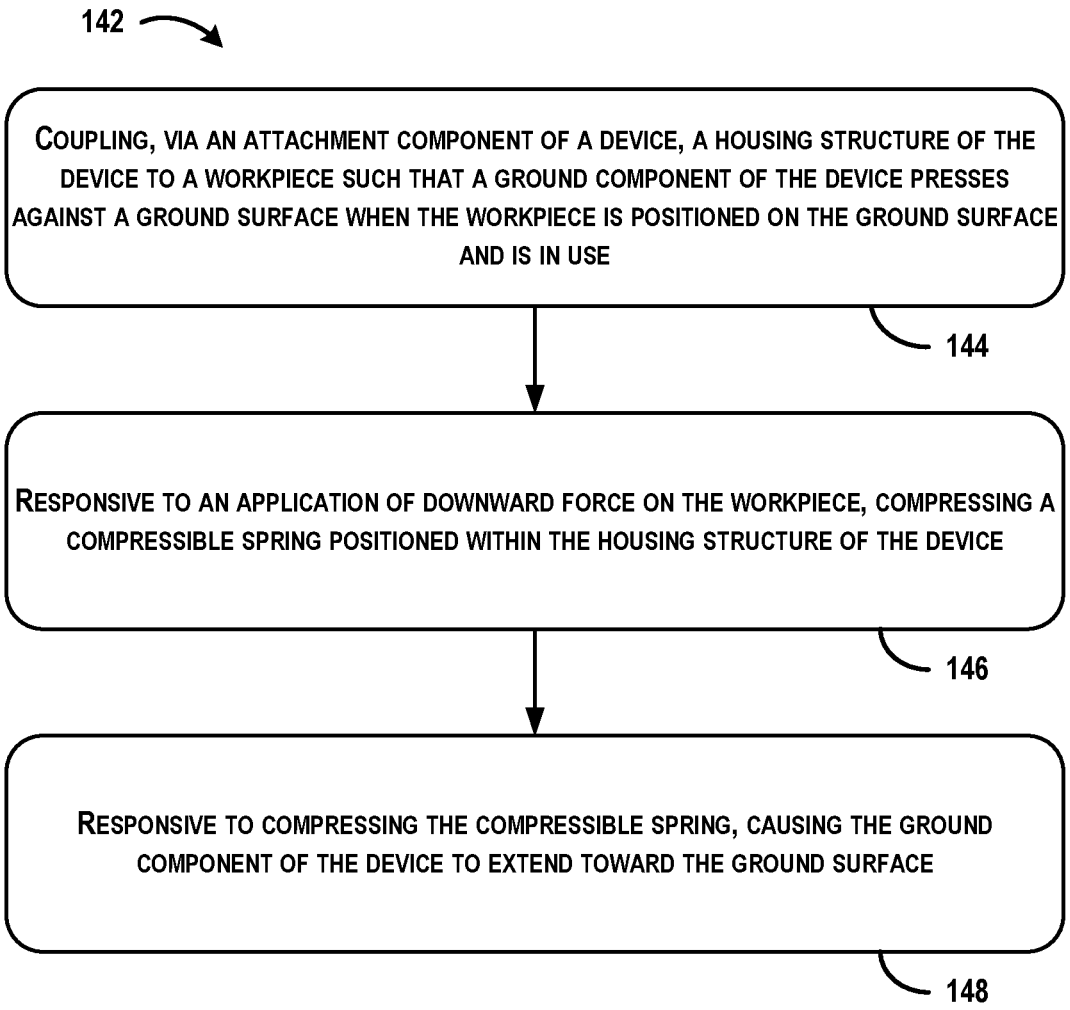
FIG. 7 shows a flowchart of an example method of electrostatic discharge of a workpiece, according to an example implementation.

FIG. 7 shows a flowchart of an example method of electrostatic discharge of a workpiece, according to an example implementation. Method 142 shown in FIG. 7 presents an example of a method that could be used with the device 100, shown in FIGS. 1-6. In other examples, components of the devices and/or systems may be arranged to be adapted to, capable of, or suited for performing the functions, such as when operated in a specific manner.

Method 142 may include one or more operations, functions, or actions as illustrated by one or more of blocks 144, 146, and 148. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

At block 144, the method 142 involves coupling, via the attachment component 130 of the device 100, the housing structure 102 of the device 100 to a workpiece (e.g., workpiece 132) such that the ground component 128 presses against a ground surface (e.g., ground surface 134) when the workpiece 132 is positioned on the ground surface 134 and is in use.

At block 146, the method 142 involves compressing the compressible spring 122 positioned within the housing structure 102 of the device 100 responsive to an application of downward force on the workpiece 132.

For instance, the application of downward force can result from additional weight on the workpiece 132 that occurs when a user climbs upon a portion of the workpiece 132. The downward force can cause the outer portion 106 of the housing structure 102 remain stationary relative to the workpiece 132 while also causing the elongate rod 108 to shift downward pushing the ground component 128 against the ground surface 134. During the application of the downward force, the ground surface 134 limits the amount that the ground component 128 and elongate rod 108 can extend forward resulting in further compression of the spring 122 inside the housing structure 102. The additional compression of the spring 122 permits the inner portion 104 of the housing structure 102 to further extend into the outer portion 106 of the housing structure 102 by an amount that proportionate to an amount of additional compression of the spring 122.

At block 148, the method 142 involves causing the ground component 128 of the device 100 to extend toward the ground surface responsive to compressing the compressible spring 122. As indicated above, the application of a downward force on the workpiece causes further compression of the compressible spring 122 and also causes the ground component 128 to press against the ground surface 134 shared by the workpiece 132. When the ground component 128 is firmly pressed against the ground surface 134, electrostatic charge built up within the workpiece 132 can discharge through the device 100 into the conductive ground surface 134 via the ground component 128. Electrostatic charge can also discharge from a workpiece via a device configured with a conductive wheel 138 in a similar manner within examples.

Figure 8:
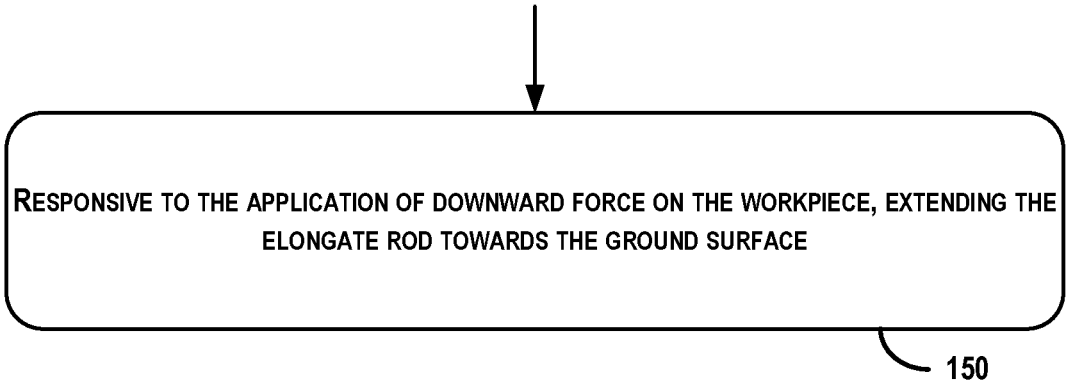
FIG. 8 shows a flowchart of another example method for use with the method shown in FIG. 7, according to an example implementation.

FIG. 8 shows a flowchart of an example method for use with the method 142, according to an example implementation. At block 150, functions include extending the elongate rod 108 towards the ground surface responsive to the application of downward force on the workpiece. The downward force on the workpiece may cause the workpiece along with the device 100 coupled to the workpiece to shift downward to the extent permitted by the structure of the workpiece 132. The downward shift can cause the elongate rod 108 to shift towards the ground surface 134, which results in pushing the ground component 128 against the ground surface 134. As a result, the device 100 can create electrical conductivity from the workpiece 132 to the ground surface 134 through the ground component 128.

By the term "substantially" or "about" used herein, it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

What is claimed is:

1. A device comprising:

a housing structure configured with an inner portion that extends partially into an outer portion, wherein the inner portion and outer portion move relative to each other;

an elongate rod positioned inside the housing structure, wherein a first end of the elongate rod extends through a top of the housing structure and a second end of the elongate rod extends through a bottom of the housing structure;

a compressible spring positioned within the housing structure, wherein the spring is partially compressed between the top of the housing structure and the bottom of the housing structure such that a first end of the spring presses against an inner surface of the outer portion of the housing structure and a second end of the spring presses against an inner surface of the inner portion of the housing structure;

a ground component coupled to the second end of the elongate rod; and an attachment component coupled to the outer portion of the housing structure, wherein the attachment component is configured to attach the device to a workpiece at a position on the workpiece proximate to a ground surface such that the ground component is in contact with the ground surface and establishes a conductive path through the device between the workpiece and the ground surface when the workpiece is stationary and positioned on the ground surface, wherein the workpiece rests on a set of non-conductive pads that engage the ground surface when the workpiece is positioned on the ground surface, and wherein the conductive path enables electrostatic charges in the workpiece to circumvent the set of non-conductive pads and transfer into the ground surface via a conductive material of the ground component.

2. The device of claim 1, wherein a diameter of the outer portion of the housing structure is greater than a diameter of the inner portion of the housing structure.

3. The device of claim 1, wherein an amount that the inner portion of the housing structure extends into the outer portion of the housing structure depends on an amount of compression of the compressible spring.

4. The device of claim 1, wherein the first end of the elongate rod extends through the top of the housing structure via a slot in the outer portion of the housing structure, and wherein the second end of the elongate rod extends through the bottom of the housing structure via a slot in the inner portion of the housing structure.

5. The device of claim 4, further comprising:

a cover component coupled to the first end of the elongate rod proximate the slot of the outer portion of the housing structure, wherein the cover component is a cap bolt; and a lock coupled to the elongate rod proximate the slot of the inner portion of the housing structure, wherein the lock is positioned outside the housing structure.

6. The device of claim 1, wherein the compressible spring is positioned around the elongate rod within the housing structure.

7. The device of claim 1, wherein all components of the device are made out of a conductive material.

8. The device of claim 1, wherein the workpiece is a ladder.

9. A system comprising:

a workpiece having a set of non-conductive pads configured to engage a ground surface when the workpiece is positioned on the ground surface;

a device coupled to the workpiece, wherein the device comprises:

a housing structure configured with an inner portion that extends partially into an outer portion, wherein the inner portion and outer portion move relative to each other;

an elongate rod positioned inside the housing structure, wherein a first end of the elongate rod extends through a top of the housing structure and a second end of the elongate rod extends through a bottom of the housing structure;

a cover component coupled to the first end of the elongate rod;

a lock coupled to the elongate rod, wherein the lock is positioned outside the housing structure;

a compressible spring positioned within the housing structure, wherein the spring is partially compressed between the top of the housing structure and the bottom of the housing structure such that a first end of the spring presses against an inner surface of the outer portion of the housing structure and a second end of the spring presses against an inner surface of the inner portion of the housing structure;

a ground component coupled to the second end of the elongate rod; and an attachment component coupled to the outer portion of the housing structure, wherein the attachment component attaches the device to the workpiece at a position on the workpiece proximate to the ground surface such that the ground component is in contact with the ground surface and establishes a conductive path through the device between the workpiece and the ground surface when the workpiece is stationary and positioned on the ground surface, wherein the workpiece rests on the set of non-conductive pads that engage the ground surface when the workpiece is positioned on the ground surface, and wherein the conductive path enables electrostatic charges in the workpiece to circumvent the set of non-conductive pads and transfer into the ground surface via a conductive material of the ground component.

10. The system of claim 9, wherein a diameter of the outer portion of the housing structure is greater than a diameter of the inner portion of the housing structure.

11. The system of claim 9, wherein an amount that the inner portion of the housing structure extends into the outer portion of the housing structure depends on an amount of compression of the compressible spring.

12. The system of claim 9, wherein the first end of the elongate rod extends through the top of the housing structure via a slot in the outer portion of the housing structure, and wherein the second end of the elongate rod extends through the bottom of the housing structure via a slot in the inner portion of the housing structure.

13. The system of claim 9, further comprising:

a second device having a configuration similar to the device, wherein the second device is coupled to the workpiece such that the second device establishes a second conductive path between the workpiece and the ground surface when the workpiece is positioned on the ground surface via the set of non-conductive pads.

14. The system of 21, wherein the workpiece corresponds to a ladder having at least a first leg and a second leg, and wherein the device is coupled to the first leg of the ladder and the second device is coupled to the second leg of the ladder.

* * * * *